US009036986B2

(12) United States Patent
Amberson

(10) Patent No.: US 9,036,986 B2
(45) Date of Patent: May 19, 2015

(54) HEATER

(76) Inventor: Bruce Amberson, Millville, UT (US)

( * ) Notice: Subject to any disclaimer, the term of this patent is extended or adjusted under 35 U.S.C. 154(b) by 69 days.

(21) Appl. No.: 13/425,617

(22) Filed: Mar. 21, 2012

(65) Prior Publication Data

US 2013/0251353 A1 Sep. 26, 2013

(51) Int. Cl.

| | |
|---|---|
| ***F24D 15/02*** | (2006.01) |
| ***F24D 13/00*** | (2006.01) |
| ***F24H 3/00*** | (2006.01) |
| ***H05B 1/02*** | (2006.01) |
| ***F24H 3/04*** | (2006.01) |
| ***F24H 9/18*** | (2006.01) |
| ***F24H 9/20*** | (2006.01) |
| ***F24D 19/06*** | (2006.01) |

(52) U.S. Cl.

CPC ..... *F24H 3/0411* (2013.01); *F24H 9/1863* (2013.01); *F24H 9/2071* (2013.01); *F24D 19/06* (2013.01); *F24D 2220/2036* (2013.01)

(58) Field of Classification Search

CPC ... F24H 3/0411; F24H 9/1863; F24H 9/2071; F24H 3/0417; F24H 3/0405; F24H 9/1872; F24D 19/06; F24D 2220/2036; Y02B 30/108; F24F 1/02; F23N 2041/14

USPC ..... 392/365, 407, 411, 416, 436, 438, 440, 392/347, 351, 355, 356, 360, 363, 366, 370, 392/371, 373, 375; 219/482, 490, 494

See application file for complete search history.

(56) References Cited

U.S. PATENT DOCUMENTS

| | | | | | |
|---|---|---|---|---|---|
| 3,203,413 | A | | 8/1965 | HartZell | |
| 3,217,139 | A | * | 11/1965 | Barber | 392/411 |
| 3,473,006 | A | * | 10/1969 | Barbier | 392/358 |
| 3,539,770 | A | | 11/1970 | Wallace | |
| 3,545,425 | A | | 12/1970 | Dikin | |
| 3,627,989 | A | * | 12/1971 | Heidler et al. | 219/553 |
| 3,731,055 | A | * | 5/1973 | Kerchner et al. | 392/423 |
| 3,733,461 | A | * | 5/1973 | Rohats | 392/423 |
| 4,307,284 | A | * | 12/1981 | Perron | 392/355 |

(Continued)

FOREIGN PATENT DOCUMENTS

| | | |
|---|---|---|
| JP | 07-139744 | 5/1995 |
| JP | 10-259955 | 9/1998 |

(Continued)

*Primary Examiner* — Dana Ross
*Assistant Examiner* — Gyounghyun Bae
(74) *Attorney, Agent, or Firm* — JP Webb; Jason P. Webb; Danny Y. H. Cheng

(57) ABSTRACT

A heater comprising a housing including an intake aperture and an output aperture. The heater includes a heat exchanger operatively disposed within the housing between the intake aperture and the output aperture. The heat exchanger includes a shell forming a cavity therein, wherein an interior surface of the shell is substantially black in the infrared domain. The heater includes an infrared emission module disposed within the cavity of the heat exchanger and substantially enclosed thereby such that emitted infrared light does not escape therefrom. The infrared emission module includes a first infrared emitter and a second infrared emitter. The heater includes a fan positioned to motivate air into the housing through the intake aperture, across the heat exchanger, and out of the output aperture. The heater also includes a power module functionally coupled to the infrared emission module and the fan and configured to provide operational power thereto.

16 Claims, 11 Drawing Sheets

(56) References Cited

U.S. PATENT DOCUMENTS

| | | | | |
|---|---|---|---|---|
| 4,640,343 | A | 2/1987 | Dearden et al. | |
| 4,680,448 | A * | 7/1987 | Fester | 392/356 |
| 4,900,898 | A * | 2/1990 | Kling | 392/503 |
| 5,511,145 | A * | 4/1996 | Bailey et al. | 392/355 |
| RE36,724 | E * | 6/2000 | Westerberg et al. | 219/685 |
| 6,327,427 | B1 * | 12/2001 | Burkett | 392/369 |
| 6,612,835 | B2 | 9/2003 | Ibrahim et al. | |
| 6,760,543 | B1 * | 7/2004 | Orr et al. | 392/365 |
| 6,973,260 | B2 * | 12/2005 | Orr et al. | 392/365 |
| 7,046,918 | B1 * | 5/2006 | Burkett et al. | 392/375 |
| 7,158,716 | B2 * | 1/2007 | Shapiro et al. | 392/365 |
| 7,593,789 | B2 * | 9/2009 | Gougerot et al. | 700/275 |
| 2003/0108841 | A1 | 6/2003 | Cooley et al. | |
| 2006/0115778 | A1 | 6/2006 | Camargo | |
| 2009/0003808 | A1 * | 1/2009 | Brooke et al. | 392/407 |
| 2009/0285567 | A1 | 11/2009 | Searle et al. | |
| 2010/0086289 | A1 * | 4/2010 | Johnson et al. | 392/490 |
| 2010/0195991 | A1 * | 8/2010 | Deivasigamani et al. | 392/308 |
| 2010/0329649 | A1 * | 12/2010 | Potter et al. | 392/416 |
| 2011/0100971 | A1 * | 5/2011 | Searle et al. | 219/210 |
| 2011/0138770 | A1 * | 6/2011 | Bryant | 60/39.092 |
| 2011/0283895 | A1 * | 11/2011 | Veltrop | 99/451 |

FOREIGN PATENT DOCUMENTS

| | | | | |
|---|---|---|---|---|
| KR | 10-2003-0018485 | | 3/2003 | |
| KR | 10-0636820 | | 10/2006 | |
| WO | WO 2008057321 | A2 * | 5/2008 | F24H 3/04 |
| WO | WO 2008140700 | A1 * | 11/2008 | F24H 3/04 |

* cited by examiner

HEATER

BACKGROUND OF THE INVENTION

1. Field of the Invention

The present invention relates to heating devices, specifically a heater including a black box exchanger.

2. Description of the Related Art

A heater is an object that emits heat or causes another body to achieve a higher temperature. In a household or domestic setting, heaters are usually appliances whose purpose is to generate heating (i.e. warmth). Heaters exists for all states of matter, including solids, liquids and gases and there are 3 types of heat transfer: Convection, Conduction and Radiation.

A heat exchanger is a piece of equipment built for efficient heat transfer from one medium to another. The media may be separated by a solid wall, so that they never mix, or they may be in direct contact. They are widely used in space heating, refrigeration, air conditioning, power plants, chemical plants, petrochemical plants, petroleum refineries, natural gas processing, and sewage treatment. The classic example of a heat exchanger is found in an internal combustion engine in which a circulating fluid known as engine coolant flows through radiator coils and air flows past the coils, which cools the coolant and heats the incoming air.

Some improvements have been made in the field. Examples of references related to the present invention are described below in their own words, and the supporting teachings of each reference are incorporated by reference herein:

U.S. Pat. No. 7,046,918, issued to Burkett et al., discloses a space heater with a linear source of infrared radiant energy in heat exchange relationship with a heat exchanger formed of copper or aluminum material. The copper is pretreated to soften the copper and partially blacken the surface thereof. The aluminum is anodized and electrolytically colored dark. The space heater is thermally more efficient than a comparable space heater wherein the copper or aluminum has not been pretreated. The linear source of infrared radiant energy and heat exchanger are mounted in a heater core that is thermally insulated by an air jacket from an exterior case.

U.S. Pat. No. 6,973,260, issued to Orr et al., discloses a portable electric heater producing a vertically oriented, heated exhaust air stream at an elevation above a support surface is provided. A base contacting the support surface and supporting an elongate housing in a substantially vertical position from the support surface. An inlet opening allows air to enter the interior of the housing and a vertically oriented outlet opening allows a heated exhaust air stream to exit the housing. An air blower assembly and elongate electric heating element are disposed within the housing. The air blower assembly has a substantially vertically oriented axis of rotation and the electric heating element is substantially vertically oriented proximate the outlet opening. The flow of the exhaust air stream from the air impeller assembly toward the vertically oriented elongate electric heating element is a substantially direct and straight vector and substantially all of the exhaust air stream passes through the electric heating element.

U.S. Pat. No. 6,612,835, issued to Ibrahim, discloses a high-temperature, non-catalytic, infrared heater is formed within a housing having a bottom and at least one side lined with a refractory material. The burner includes a burner surface area and is positioned within the housing. A re-radiating surface is positioned above the burner and comprises a mesh having a re-radiating surface area greater than the burner surface area with the re-radiating surface operating between approximately 400 F. and 2200 F.

U.S. Pat. No. 4,900,898, issued to Kling, discloses an electric space heater includes an exterior case (10) which encloses an insulated heater core housing (12). Heat is generated in the heater core (14) by elongated incandescent ultraviolet lamps (64) mounted in a frame (60) inside the core housing (12). A porous aluminum sheet heat exchanger (68) surrounds the lamps (64) on three sides and extends the length of the lamps. A fan (34) mounted in an inlet opening (27) of a rear wall (22) of the case (10) forces air through an opening (52) in the core housing (12) through the heat exchanger (68) and around the lamps, and through outlet openings (28, 54) to the space to be heated. The core housing (12) is U-shaped with curved portions (46, 48) to laminate the air flow.

The inventions heretofore known suffer from a number of disadvantages which include being inefficient, being bulky, being difficult to install, expensive, expensive to ship and/or store, being limited in use, being limited in application, being difficult to maintain a constant temperature, being ineffective, being limited in heat output, being difficult to manage or maintain, having poor heat transfer properties, heating too slowly, heating a room in an uncomfortable manner, failing to heat air sufficiently before blowing the same to a space to be heated, generating room temperature fluctuations that are too great, and the like and combinations thereof.

What is needed is a heater that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available heaters. Accordingly, the present invention has been developed to provide an efficient and effective heating device.

According to one embodiment of the invention, there is a heater that may include a housing. The housing may include an intake aperture and an output aperture. The intake aperture may be disposed along the sides of the housing. The heater may include a heat exchanger that may be operatively disposed within the housing between the intake aperture and the output aperture. The heat exchanger may include a shell forming a cavity therein, wherein an interior surface of the shell may be substantially black in the infrared domain. The shell of the heat exchanger may include anodized aluminum.

The heater may include an infrared emission module that may be disposed within the cavity of the heat exchanger and may be substantially enclosed thereby such that emitted infrared light does not escape therefrom. The infrared emission module may include a first infrared emitter, a second infrared emitter, a third infrared emitter, and/or a fourth infrared emitter. The heater may include a fan that may be positioned to motivate air into the housing through the intake aperture, across the heat exchanger, and out of the output aperture. The heater may include a power module that may be functionally coupled to the infrared emission module and the fan and configured to provide operational power thereto.

The heater may include a control module that may be in operative communication with the infrared emission module. The control module may include a set of instructions for performing the steps of receiving ambient air data regarding temperature of ambient air surrounding the heater. The set of instructions may include comparing ambient air data against a first temperature value and against a second temperature value, each of the first and second temperature values may be stored in memory and the second temperature value representing a higher temperature than that represented by the first temperature value. The instructions may include issuing an instruction to deactivate the second infrared emitter of the infrared emission module device when ambient air temperature as represented by ambient air data surpasses the temperature represented by the first temperature value. The set of instructions may include issuing an instruction to activate the second infrared emitter of the infrared emission module device when ambient air temperature as represented by ambient air data drops below the temperature represented by the first temperature value. The set of instructions may further include issuing an instruction to deactivate the first infrared emitter of the infrared emission module device when ambient air temperature as represented by ambient air data surpasses the temperature represented by the second temperature value.

The control module may have a set of instructions that may include receiving ambient air data regarding temperature of ambient air surrounding the heater. The instructions may include receiving output air data regarding temperature of air exiting the output aperture of the housing. The set of instructions may include calculating a difference between the ambient air data and the output air data. The set of instructions may include comparing the calculated difference against a preset delta value stored in memory and issuing an instruction to slow the fan if the calculated difference is greater than the preset delta value. The control module may also store user modification with environmental and time context such that user behavior can be used predicatively. There may be a motion detection module that may be in communication with the control module and operation of the heater may depend on and/or may change in response to information received from the motion detector module.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
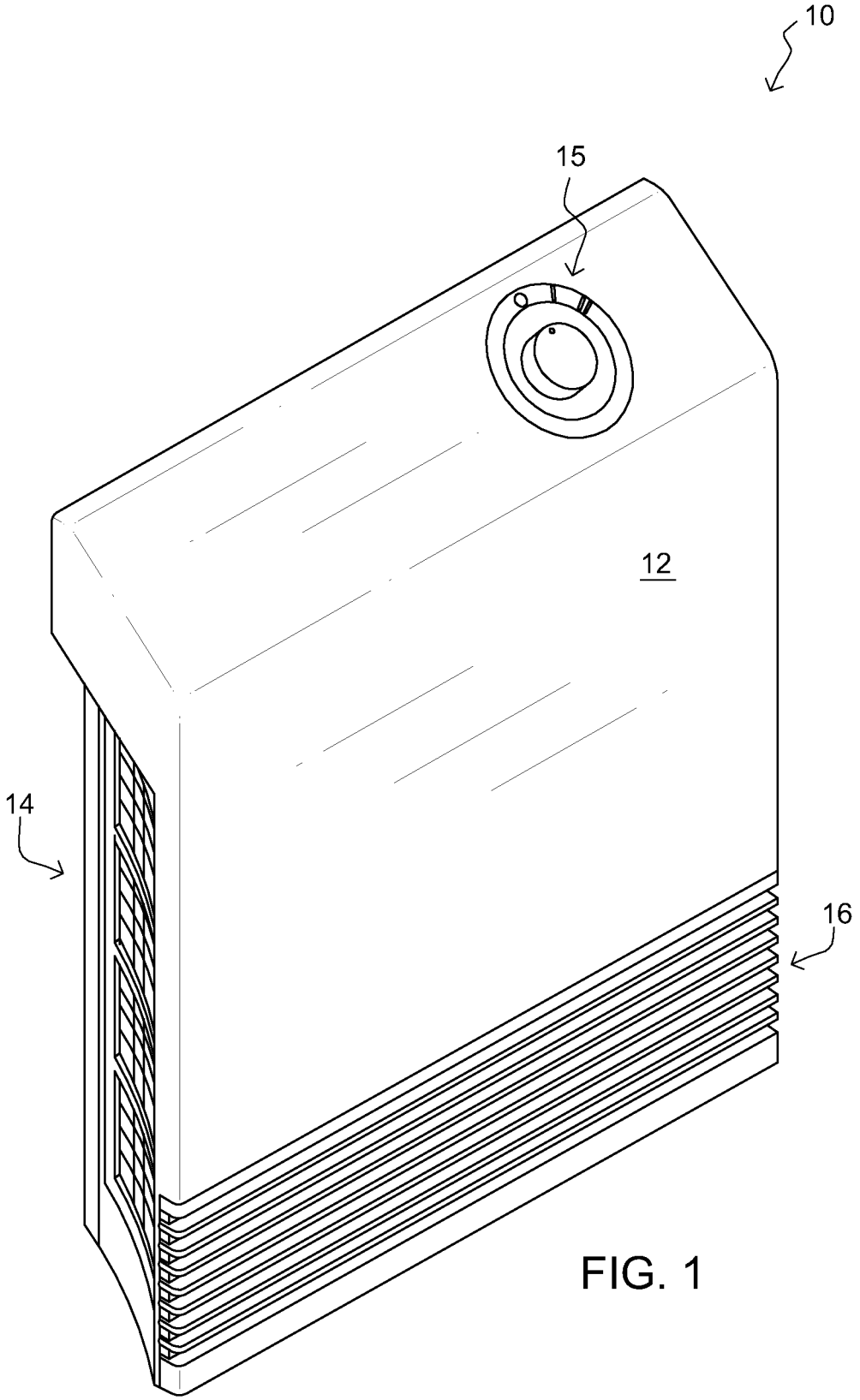
FIG. 1 illustrates a perspective view of a heater, according to one embodiment of the invention.
Figure 3:
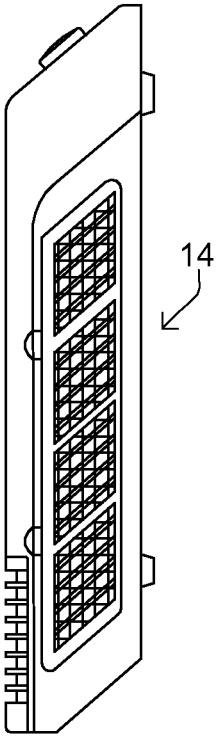
FIG. 3 illustrates a side elevational view of a heater, according to one embodiment of the invention.
Figure 2:
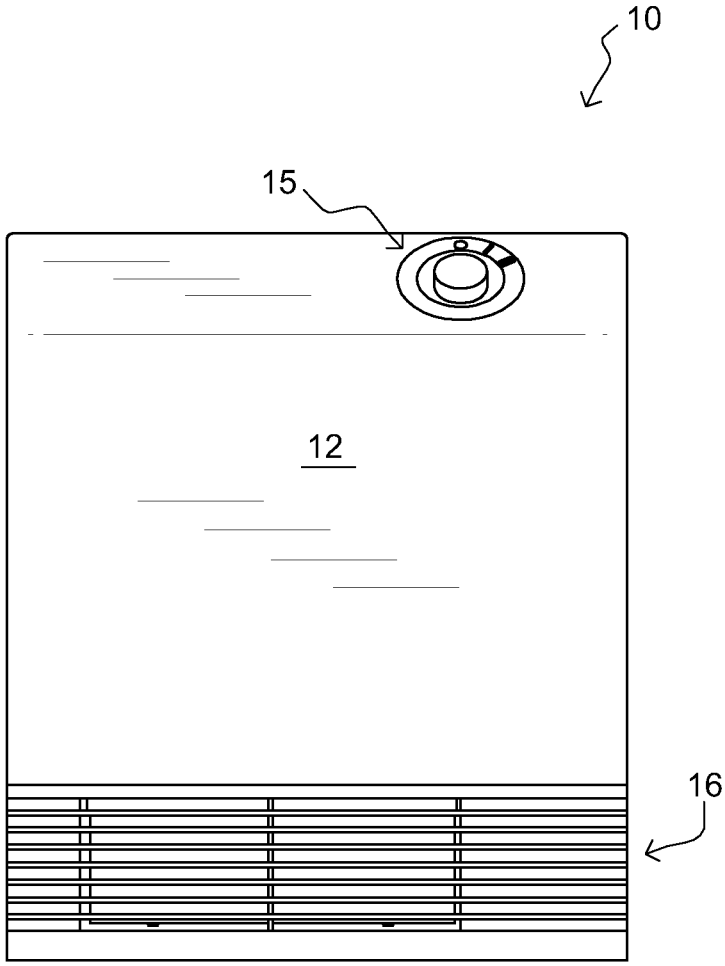
FIG. 2 illustrates a front elevational view of a heater, according to one embodiment of the invention.
Figure 4:
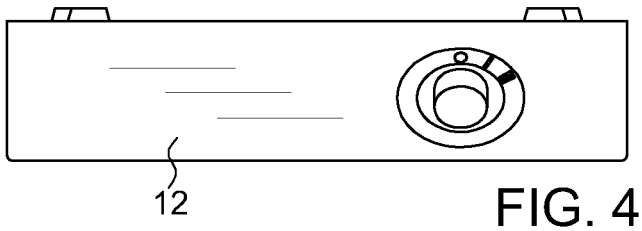
FIG. 4 illustrates a top plan view of a heater, according to one embodiment of the invention.
Figure 5:
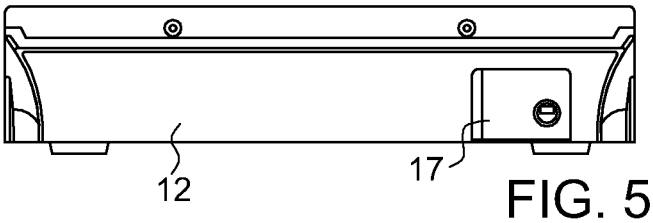
FIG. 5 illustrates a bottom plan view of heater, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows, NT, 95/98/2000, OS2; UNIX; Linux; Solaris; MacOS; Google Android; Apple iOS; mobile operating systems, and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, PHP, Visual Basic, SQL, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript, DHTML, HTML, or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, environmentally sensitive devices, cameras, motion detectors and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), Bluetooth, Zigbee, networked or linked devices and/or the like. Moreover, although the invention may be implemented with TCP/IP communications protocols, the invention may also be implemented using IPX, Appletalk, IP-6, NetBIOS, OSI, Bluetooth, Zigbee, or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 illustrates a perspective view of a heater, according to one embodiment of the invention. There is shown a heater 10 including a housing 12, an intake aperture 14 disposed along a side of the housing 12, an output aperture 16 disposed on a front portion of the housing 12, and an interface module 15 disposed on a top portion of the housing 12.

The illustrated heater 10 is configured to heat the ambient air surrounding the heater 10 by heating the ambient air drawn in from the intake aperture 14 and expelling the heated air through the output aperture 16. The heater 10 includes a housing 12 configured to secure the components and modules of the heater 10, therein. The intake aperture 14 is disposed along a side of the housing 12 configured to draw ambient air therethrough into the housing 12 of the heater 10. The heater 10 includes an output aperture 16 in communication with the intake aperture 14 and configured to disperse heated air out therefrom. The heater 10 includes an interface module 15 configured to control the amount of ambient air drawn into the heater and the temperature of the heated air leaving the output aperture. A non-limiting example of an interface module may be a Non-limiting examples of a display/interface module may be a display/interface module as described in U.S. Pat. No. 6,272,562, issued to Scott et al.; a touch screen interface module as described in U.S. Pat. No. 5,884,202 and U.S. Pat. No. 6,094,609, issued to Arjomand, which are incorporated for their supported teachings herein.

FIGS. 2-5 illustrate a pair of elevational views and a pair of plan views of a heater, according to one embodiment of the invention. There is shown a heater 10 including a housing 12, an intake aperture 14 disposed along a side of the housing 12, an output aperture 16 disposed on a front portion of the housing 12, and an interface module 15 disposed on a top portion of the housing 12.

The illustrated heater 10 is configured to heat the ambient air surrounding the heater 10 by heating the ambient air drawn in from the intake aperture 14. The heater 10 includes a housing 12 configured to secure the components and modules of the heater 10, therein. The intake aperture 14 is disposed along a side of the housing 12 configured to draw ambient air therethrough into the housing 12 of the heater 10. The heater 10 includes an output aperture 16 in communication with the intake aperture 14 and configured to disperse heated air out therefrom. The heater 10 includes an interface module 15 configured to provide operational controls to the heater 10. The heater 10 includes a power module 17 configured to provide power to the modules and components of the heater 10. Non-limiting examples of a power module may be a power module described in U.S. Pat. No. 6,337,803, issued to Kikcuhi et al.; or a power module described in U.S. Pat. No. 5,608,595, issued to Gourab et al. which are incorporated for their supported teachings herein. The power module 17 may include a power outlet or remote power, such as batteries or a rechargeable battery or power supply.

Figure 6:
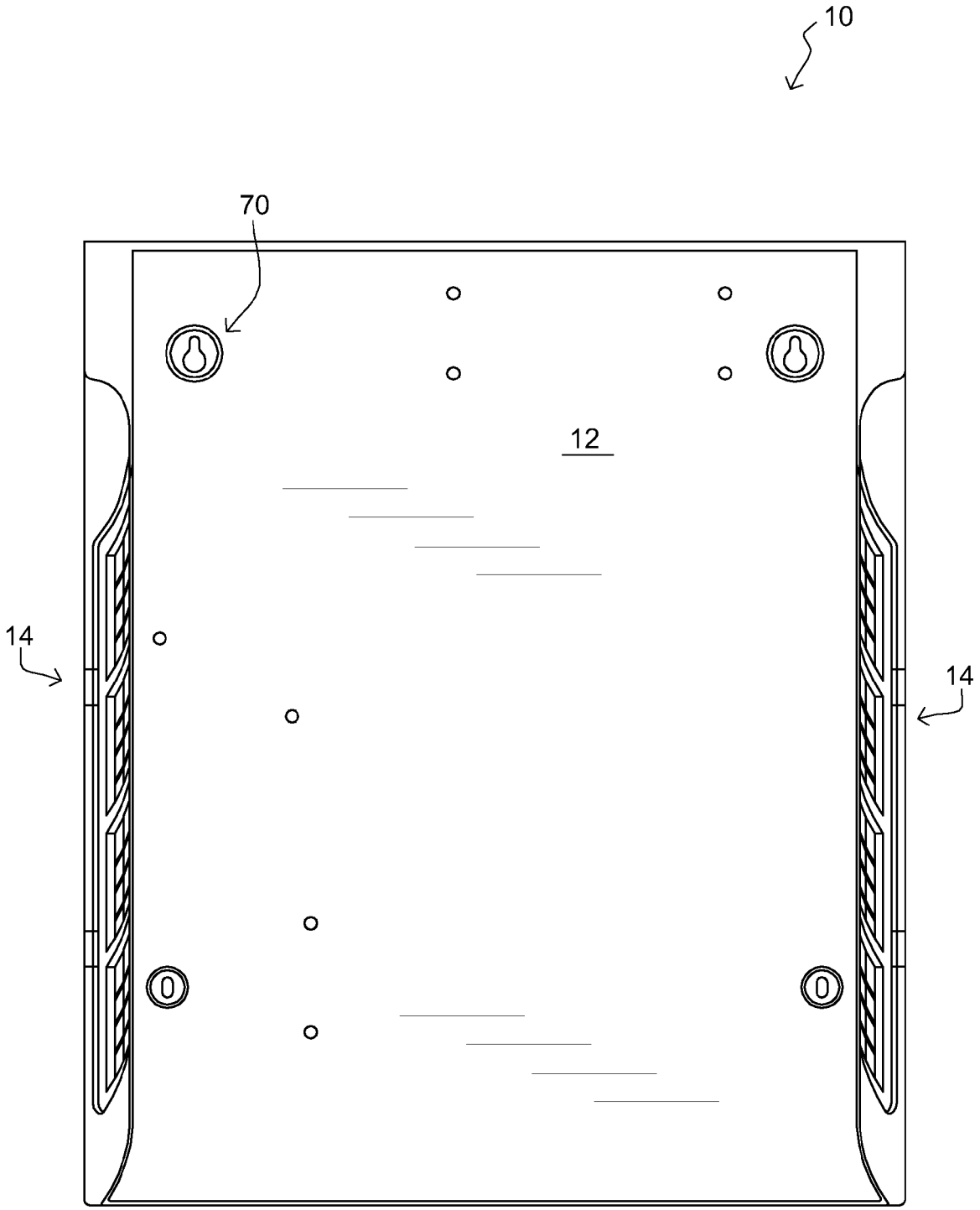
FIG. 6 illustrates a back elevational view of a heater, according to one embodiment of the invention.

FIG. 6 illustrates a back elevational view of a heater, according to one embodiment of the invention. There is shown a heater 10 including a housing 12 including intake aperture 14 disposed along sides of the housing 12.

The illustrated heater 10 is configured to heat ambient air of a room where the heater 10 is disposed. The heater 10 includes a housing 12 configured to couple to a wall or structure of a room. The illustrated housing 12 includes a set of wall coupling members 70, wherein the wall coupling members 70 each include an opening and a channel in communication with the opening. The opening is configured to receive a head member of a screw or nail (or other coupling device configured to couple a structure to a surface), wherein the screw or nail is configured to be anchored to a wall or structure of a room. The wall coupling members 70 are configured to fit over the head of the screw or nail and slide downwardly, thereby securing the head of the screw or nail into the channel of the wall coupling member 70, thereby securing the housing 12 of the heater 12 to a wall or structure of a room.

Figure 7:
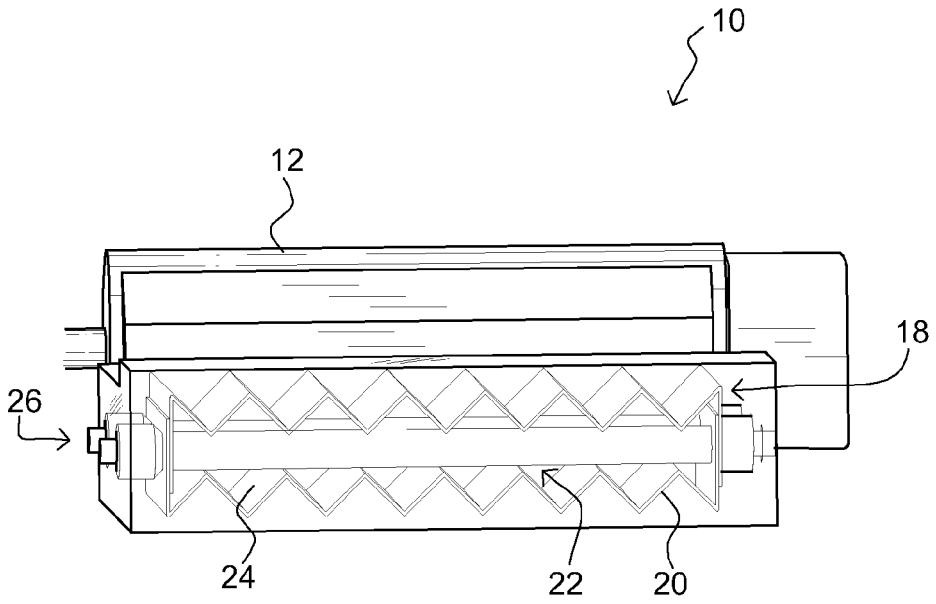
FIG. 7 illustrates a bottom perspective view of a heat exchanger of a heater, according to one embodiment of the invention.
Figure 8:
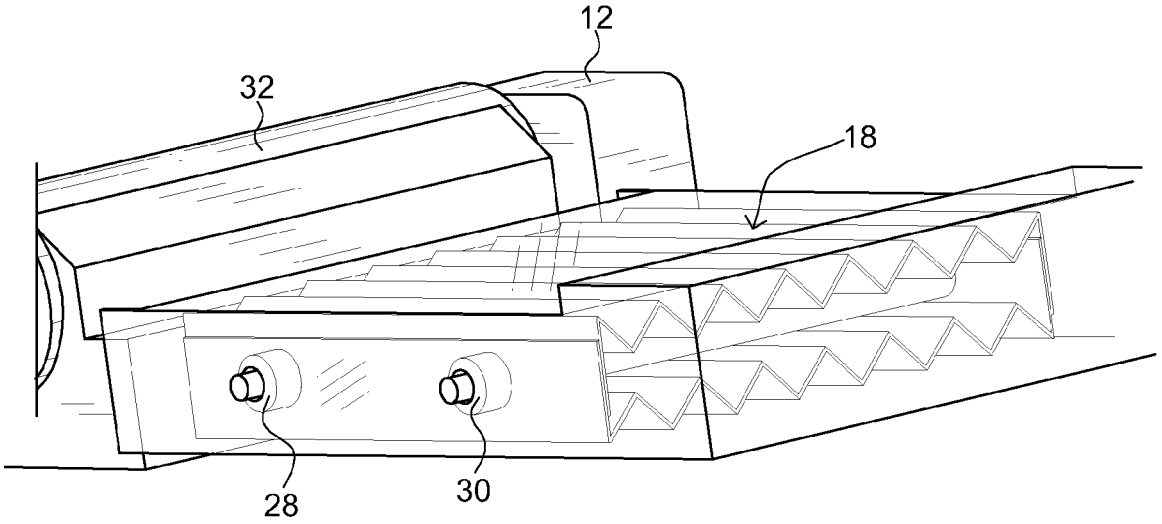
FIG. 8 illustrates a perspective view of a heat exchanger of a heater, according to one embodiment of the invention.

FIGS. 7 and 8 illustrate perspective views of a heat exchanger of a heater, according to one embodiment of the invention. There is shown a heater 10 including a housing 12 and a heat exchanger 18 disposed therein, wherein an infrared emission module 26 is disposed within the heat exchanger 18. In addition, the illustrated heater 10 includes a fan 32 disposed about a top portion of the housing 12.

The illustrated heater 10 includes a housing 12 configured to secure the components and modules of the heater 10 therein. The heater 10 includes a heat exchanger 18 that is operatively disposed within the housing 12 between an intake aperture and an output aperture of the housing 12. The heat exchanger 18 includes a shell 20 forming a cavity 22 therein, wherein an interior surface 24 of the shell 20 is substantially black in the infrared domain. The black interior surface 24 of the shell 20 of the heat exchanger 18 is configured to absorb heat emission from an infrared emission module 26 disposed therein, wherein the color black captures more infrared emissions and increases the temperature of the air passing therethrough. The shell 20 of the heat exchanger 18 includes anodized aluminum that has not been subject to processing to make the surface reflective. The shell 20 of the heat exchanger 18 includes a plurality of ridges configured to expand the surface area of the heat exchanger 18, thereby increasing the temperature of the air passing therethrough. The shell substantially covers the infrared emission module 26 such that there are substantially no apertures about four of the six cubic/rectangular sides that may be covered by the shell. "Substantially no apertures" means that there are no apertures that permit a direct line of sight from an exterior of the shell to an operative surface of the infrared emission module. It is common for heat exchangers to include a multitude of apertures, such that the heat exchanger has a mesh or net-like appearance that permits infrared energy to escape the same, whereas the illustrated shell is different from such.

The heater 10 includes an infrared emission module 26 that is disposed within the cavity 22 of the heat exchanger 18. The infrared emission module 26 is substantially enclosed thereby such that emitted infrared light does not escape therefrom. This advantageously increases efficiency of the heater while reducing heat transfer to the housing of the heater, thereby protecting users thereof from heated housings and permitting the housing to be smaller. Accordingly, the heater may be placed more easily, interfere less with its surroundings, be less expensive, and/or be less expensive to ship/store.

The illustrated infrared emission module 26 includes a first infrared emitter 28 and a second infrared emitter 30 configured to emit infrared light, thereby producing heat therefrom. The first infrared emitter 28 and the second infrared emitter 30 are disposed in parallel within the cavity 22 of the heat exchanger 18. Non-limiting examples of infrared emission modules include but are not limited to an infrared emitter described in U.S. Pat. No. 6,297,511, issued to Syllaios et al.; an infrared emitter described in U.S. Pat. No. 3,346,723, issued to Mohn et al.; or an infrared emitter described in U.S. Pat. No. 7,170,071, issued to Broussard, the supporting teachings of which are incorporated by reference herein.

The heater 10 includes a fan 32 that is positioned to motivate air into the housing 12 through an intake aperture, across the heat exchanger 18, passed the infrared emission module 26 and out of an output aperture. The illustrated fan 32 is disposed about a top portion of the housing 12 and configured to motivate air in through an intake aperture, into the housing 12, through and around the heat exchanger 18 and the infrared emission module 26 and out an output aperture.

Figure 9:
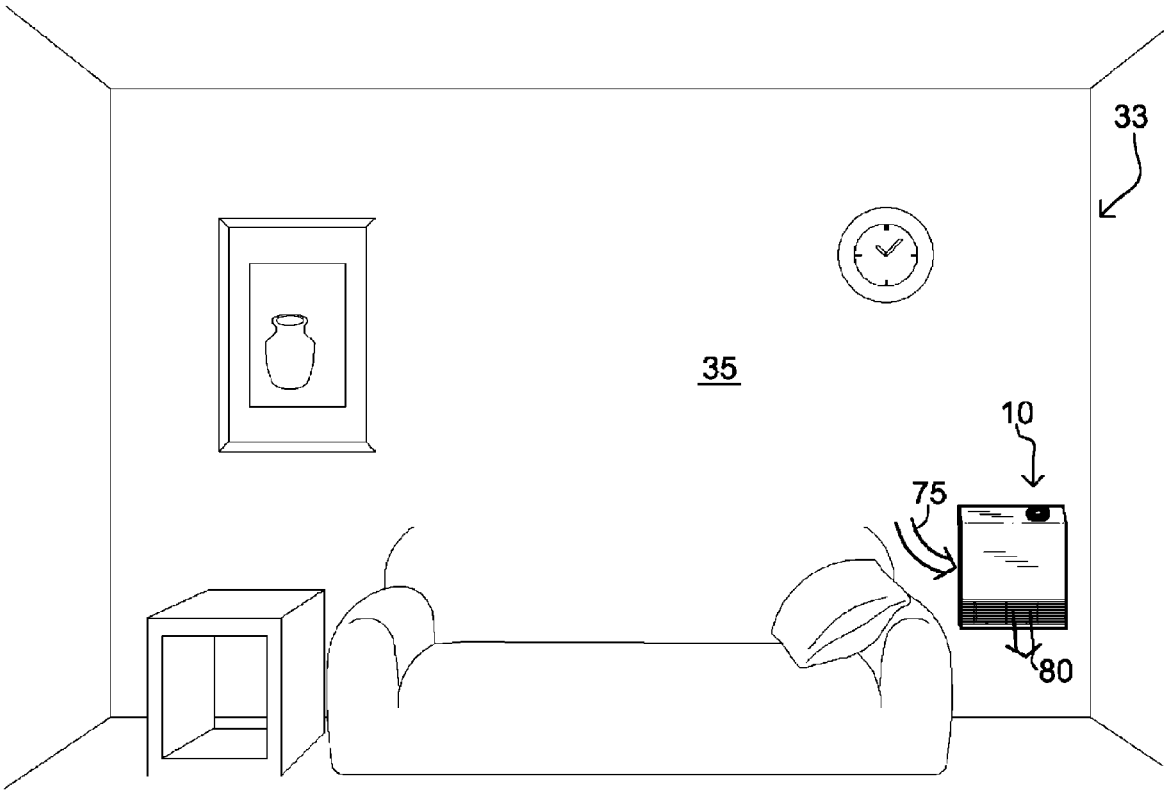
FIG. 9 illustrates a perspective view of a heater coupled to a wall of a room, according to one embodiment of the invention.

FIG. 9 illustrates a perspective view of a heater coupled to a wall of a room, according to one embodiment of the invention. There is shown a heater 10 coupled to a wall 35 of a room 33.

The illustrated heater 10 is configured to heat the ambient air within a room 33. The ambient air is configured to enter through an intake aperture disposed on a side of the heater 75 and exit out an output aperture disposed about a front portion of the heater 80. Ambient air that has not been circulated is typically coolest around the exterior walls of a room. Therefore, disposing an intake aperture up against the exterior wall of a room, such as along a side of the housing of the heater, increases the efficiency of heating a room to a desired temperature since heat flux between materials is greater where there is a greater difference between respective temperatures.

Figure 10:
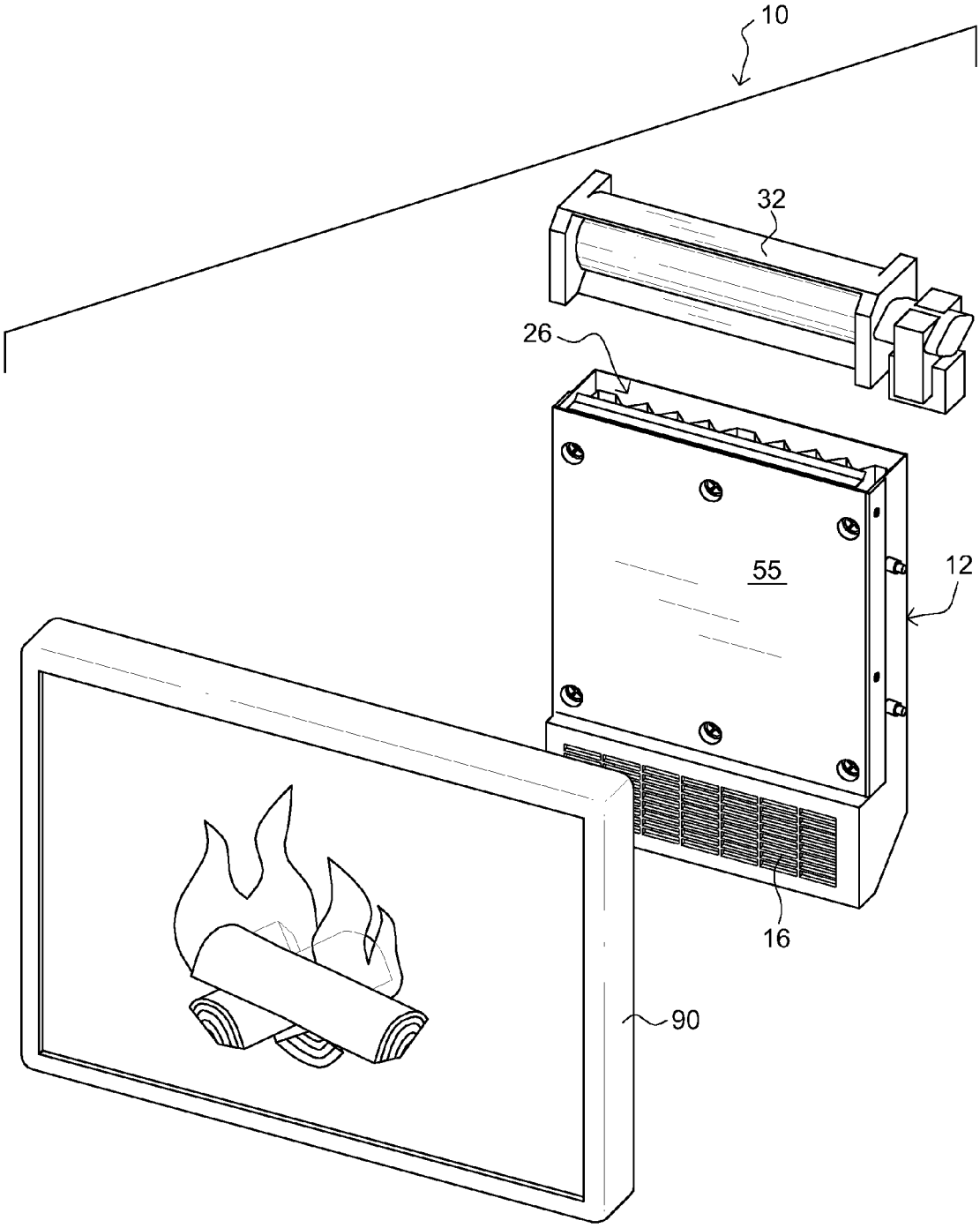
FIG. 10 illustrates a perspective view of a display module coupled to a housing of a heater, according to one embodiment of the invention.

FIG. 10 illustrates a perspective view of a display module coupled to a housing of a heater, according to one embodiment of the invention. There is shown a heater 10 including a fan 32, a housing 12, and a display screen 90.

The illustrated heater 10 is configured to heat the ambient air of a room to a desired temperature. The heater 10 includes a housing 12 configured to secure the components and modules of an infrared emission module 26 therein. The heater 10 includes a fan 32 configured to motivate air into the housing 12 through an intake aperture, across the infrared emission module 26, and out of an output aperture 16. The infrared emission module 26 is configured to provide heating elements to the heater 10 and heat the ambient air entering the heater 10. The illustrated housing 12 includes a front portion 55 configured to couple to a display module 90, such as a flat screen television. The display module 90 is configured to display an audio visual display, such as a fireplace.

Figure 11:
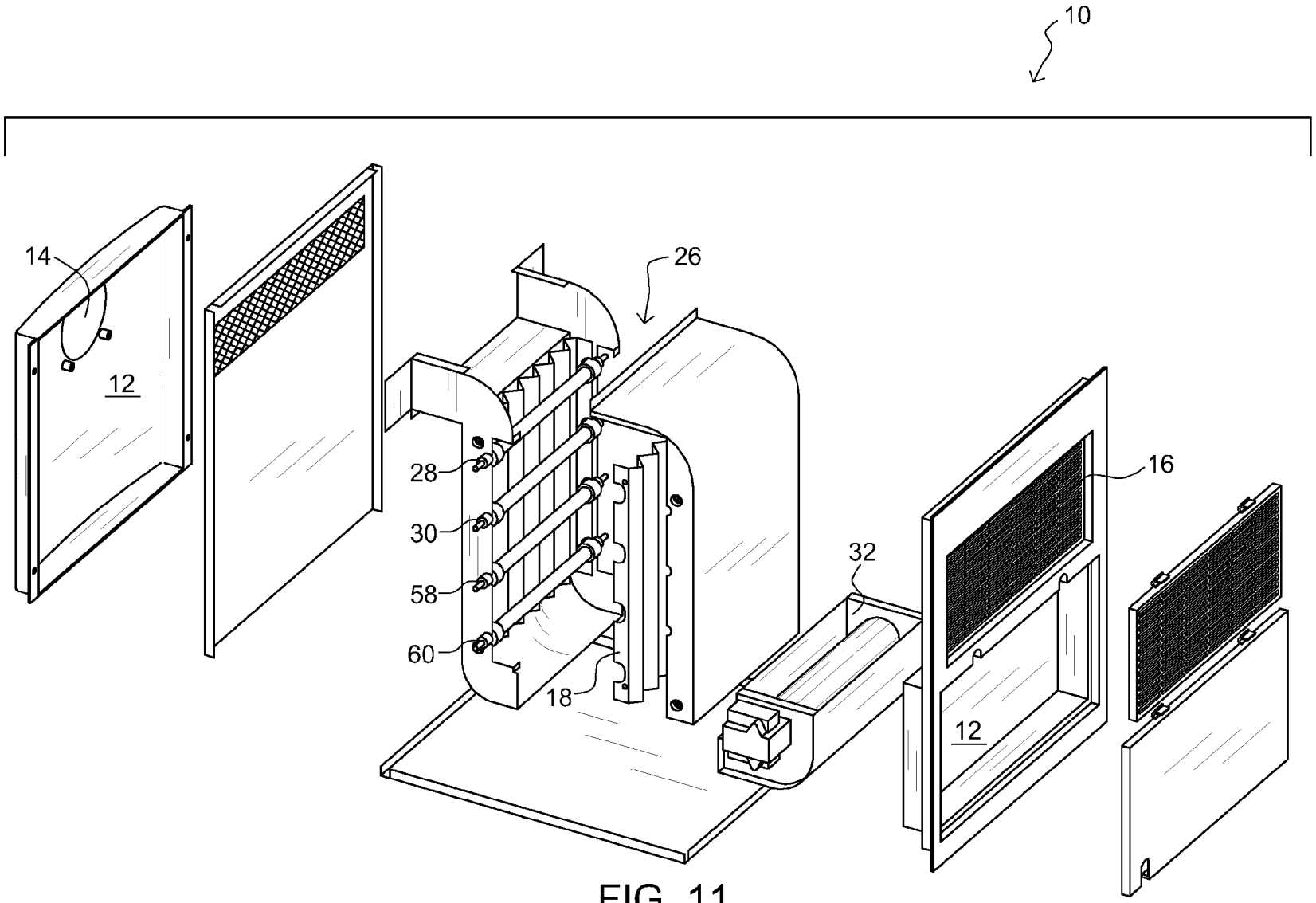
FIG. 11 illustrates an exploded view of a heater, according to one embodiment of the invention.

FIG. 11 illustrates an exploded view of a heater, according to one embodiment of the invention. There is shown a heater 10 including a housing 12, an intake aperture 14, a fan 32, an infrared emission module 26, and an output aperture 16.

The illustrated heater 10 including a housing 12 configured to secure the components and modules of the heater 10. The housing 12 includes an intake aperture 14 disposed about a back portion of the housing 12 of the heater 10. The housing 12 also includes an output aperture 16 disposed about a front portion of the housing 12 of the heater 10. The heater 10 includes a heat exchanger 18 that is operatively disposed within the housing 12 between the intake aperture 14 and the output aperture 16. The heat exchanger 18 is configured to increase the temperature of the ambient air passing there through.

The illustrated heater 10 includes an infrared emission module 26 that is disposed within a cavity of the heat exchanger 18. The infrared emission module 26 is substantially enclosed thereby such that emitted infrared light does not escape therefrom. The infrared emission module 26 includes a first infrared emitter 28, a second infrared emitter 30, a third infrared emitter 58, and a fourth infrared emitter 60. The illustrated infrared emitters 28, 30, 58, 60 are disposed in parallel succession within the heat exchanger 18. The heater 10 includes a fan 32 that is positioned to motivate air into the housing 12 through the intake aperture 14, across the heat exchanger 18 and the infrared emission module 26, and out of an output aperture 16.

Figure 12:
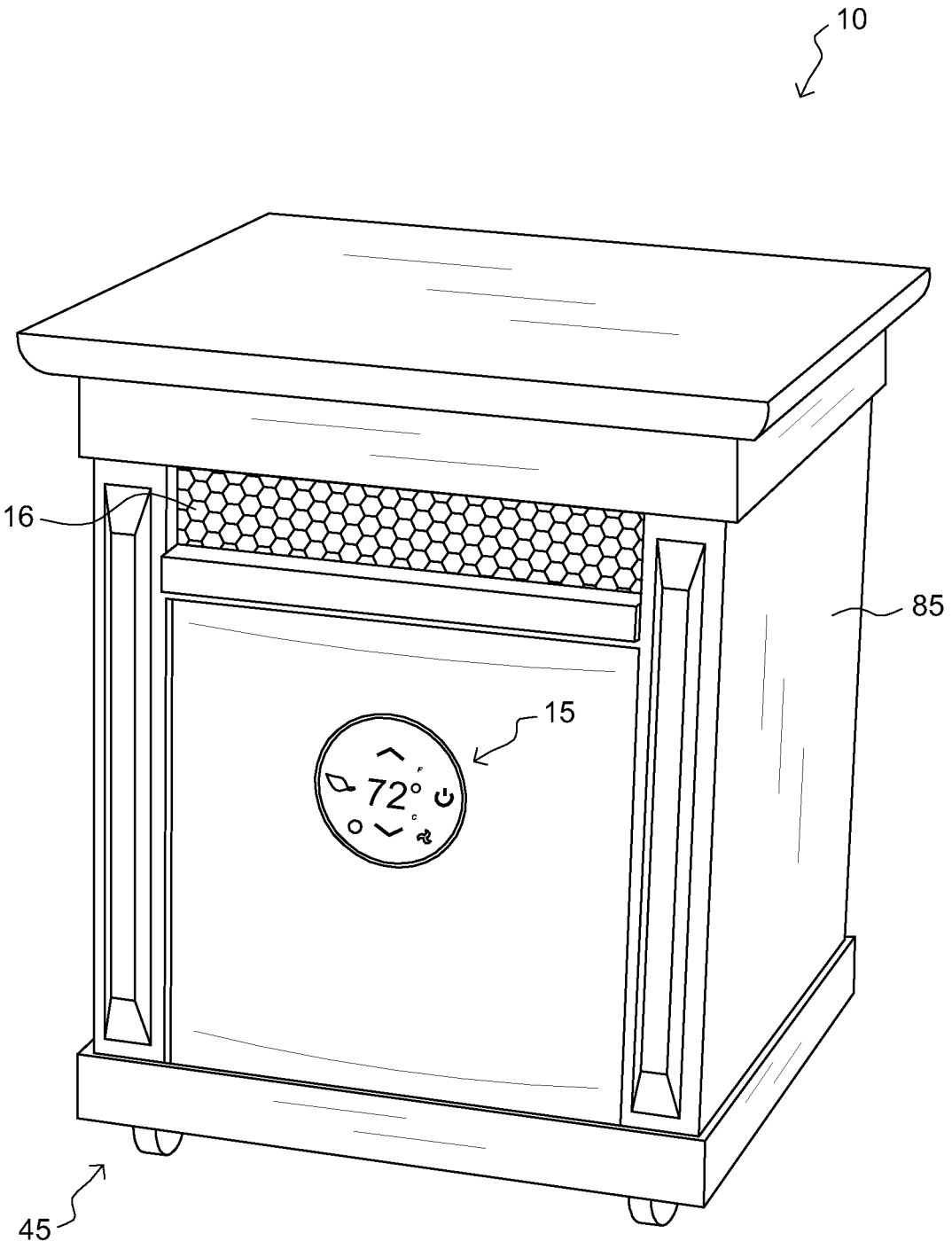
FIG. 12 is a perspective view of a heater, according to one embodiment of the invention.

FIG. 12 is a perspective view of a heater, according to one embodiment of the invention. There is shown a heater 10 disposed within a casing 85 including a plurality of wheels 45.

The illustrated heater 10 is configured to heat ambient air disposed about the heater 10. The heater 10 is disposed within a casing 85 configured to resemble a piece of furniture such as an end table. The casing 85 may be a single piece coupled to a housing of the heater or may be a part of the housing. The casing 85 includes a plurality of wheels 45 disposed about a bottom portion of the casing 85. The plurality of wheels 45 are configured to provide movement to the heater 10, thereby providing an efficient method to move the heater 10 from room to room or place to place. The heater 10 includes an output aperture 16 disposed about a front portion of the heater 10 and casing 85 configured to disperse heated ambient air therethrough. The heater 10 includes an interface module 15 disposed on a front portion of the casing 85 and configured to provide operational controls to the components and modules of the heater 10.

Figure 13:
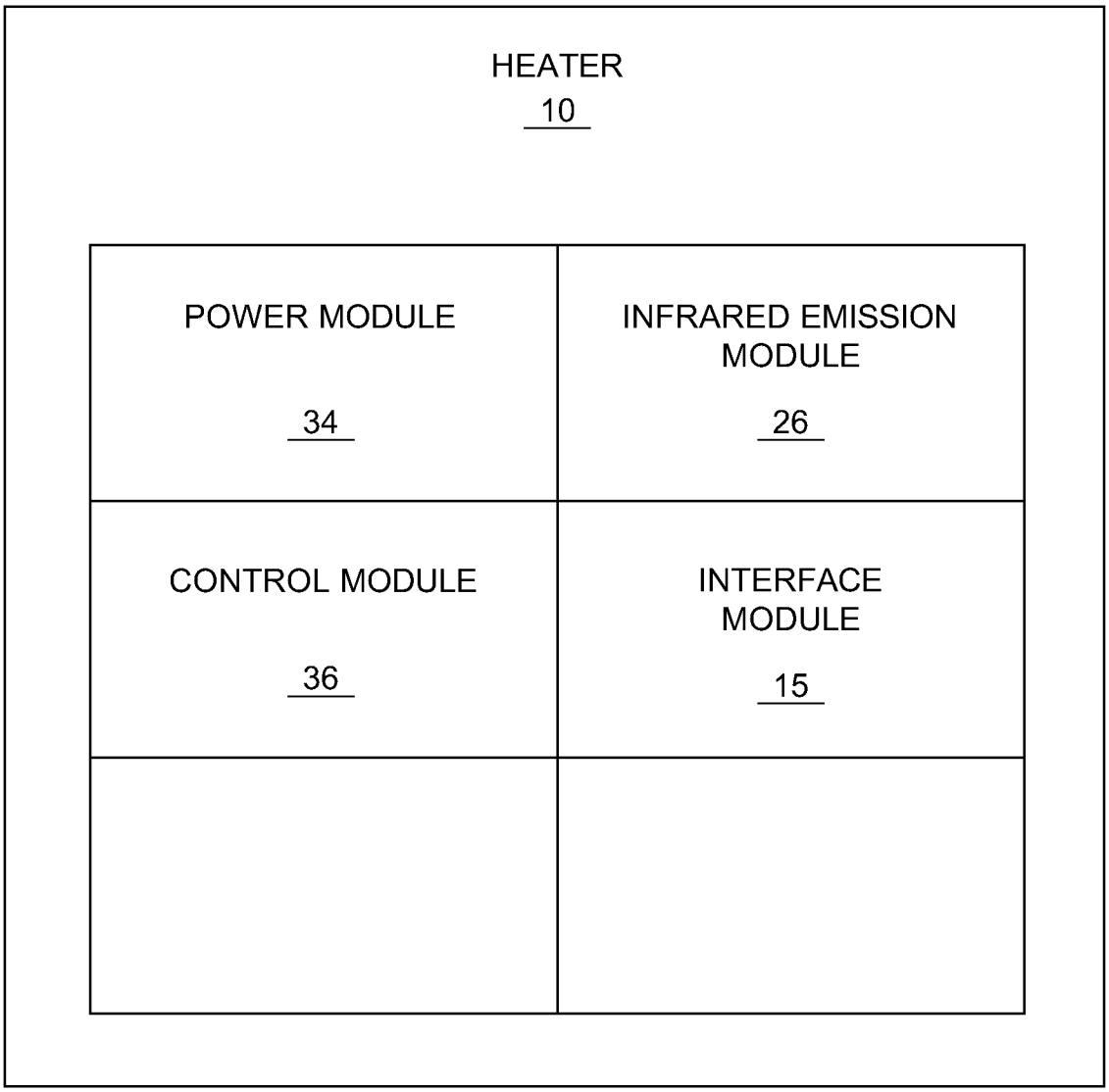
FIG. 13 is a module diagram of a heater, according to one embodiment of the invention.

FIG. 13 is a module diagram of a heater, according to one embodiment of the invention. The heater 10 includes a power module 34, a control module 36, an infrared emission module 26, and an interface module 15.

The illustrated heater 10 includes a power module 34 functionally coupled to the components and modules of the heater 10. The power module 34 is configured to provide power to the components and modules of the heater 10.

The heater 10 includes a control module 36 in operative communication with the components and modules of the heater 10. The control module 36 is configured to provide operational instructions to the modules and components of the heater 10. A control module 10 may include one or more of the following that may be operatively coupled to each other in any manner known in the art: state machine, central processing unit (CPU), bus, memory device, computer, server, networking device, and the like and combinations thereof. Non-limiting examples of a control module may be a control module described in U.S. Pat. No. 5,430,836, issued to Wolf et al.; or a control module described in U.S. Pat. No. 6,243,635, issued to Swan et al. which are incorporated for their supported teachings herein. A control module may include but is not limited to a processor, a state machine, a script, a decision tree, and the like. Non-limiting examples of memory devices include ROM, RAM, Solid State memory, hard drives, tape drives, flash drives, optical memory devices, Smart LCD displays, Smart Plasma displays, Smart LED displays, and the like and combinations thereof, including but not limited to: a HP Storage Works P2000 G3 Modular Smart Array System, manufactured by Hewlett-Packard Company, 3000 Hanover Street, Palo Alto, Calif., 94304, USA; a Sony Pocket Bit USB Flash Drive, manufactured by Sony Corporation of America, 550 Madison Avenue, New York, N.Y., 10022; or Data storage modules may be databases or data files, and the memory storage device may be hard drives or tapes. A non-limiting example of a data base is Filemaker Pro 11, manufactured by Filemaker Inc., 5261 Patrick Henry Dr., Santa Clara, Calif., 95054, or a memory modules described in U.S. Pat. No. 6,661,092, issued to Shibata et al.; or a memory module as described in U.S. Pat. No. 7,072,201, issued to So et al., the supporting teachings of which are incorporated by reference herein.

The heater 10 includes an infrared emission module 26 functionally coupled to the power module 34, the control module 36, and an interface module 15. Such coupling may be through wired and/or wireless connections that may transmit one or more of data, commands, power, and the like and combinations thereof. The infrared emission module 26 is configured to emit infrared light to heat ambient air flowing through the heater 10. The heater 10 includes an interface module 15 in operative communication with the modules and components of the heater 10. The interface module 15 is configured to provide operational controls to the modules and components of the heater.

Figure 14:
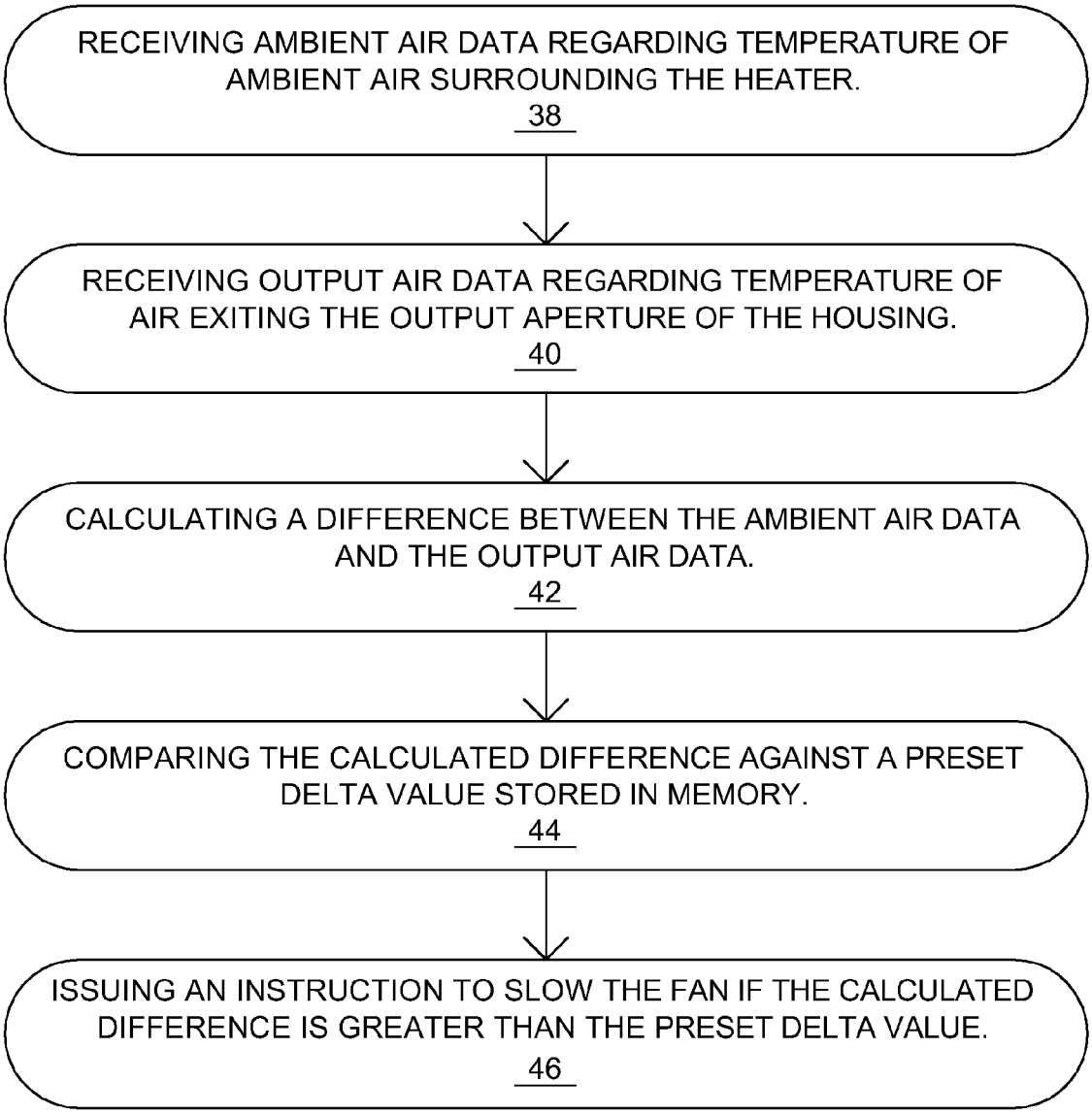
FIG. 14 is a flow chart of a sequence of instructions of a control module of a heater, according to one embodiment of the invention.

FIG. 14 is a flow chart of a sequence of instructions of a control module of a heater, according to one embodiment of the invention. There is shown a set of instructions from a control module configured to slow down a rate of ambient air passing through the heater.

The control module includes a set of instructions that includes receiving ambient air data regarding temperature of ambient air surrounding the heater 38. The instructions include receiving output air data regarding temperature of air exiting the output aperture of the housing 40. The set of instructions includes calculating a difference between the ambient air data and the output air data 42. The set of instructions also includes comparing the calculated difference against a preset delta value stored in memory 44 and issuing an instruction to slow the fan if the calculated difference is greater than the preset delta value 46.

As a non-limiting example, a heater may be activated in a room having an ambient air temperature of 62 degrees Fahrenheit. Such heater may include a temperature sensor disposed thereon and in communication with a control module of the heater. Non-limiting examples of temperature sensors include those described in: U.S. Patent Publication No.: 2009/0207882, by Yu; U.S. Pat. No. 5,772,326, issued to Batko et al.; and U.S. Patent Publication No.: 2010/0254429, by Shumaker et al., the supporting teachings of which are incorporated by reference herein. The heater may also include a memory device in communication with the control module wherein preset temperatures and/or other data such as delta values may be stored. One or more interface modules may permit control, setting, initialization, and/or alteration of such settings and thereby the data stored in the memory device(s). For purposes of this example, a delta value corresponding to 5 degrees Fahrenheit may be stored therein and such may be associated with a target temperature value corresponding to 72 degrees Fahrenheit. The heater, when activated may receive data regarding the 62 degree ambient temperature, subtract the same from the 72 degree target temperature, resulting in an actual delta of 10 degrees, compare the actual delta of 10 degrees with the stored delta value of 5 degrees, recognize that the actual delta is greater than the stored delta and then issue a command to alter a fan speed (generally slowing it down or starting it at a slower setting than otherwise) so that air traversing the heat exchanger may be heated to a higher temperature before exiting and so that the experienced "wind chill" of the heater itself is more comfortable to occupants of the room.

It is understood that the above example is a simple version of possible operation and that more complicated variations are contemplated in this application, including but not limited to having a plurality of stored delta values associated with one or more target temperatures, wherein stored delta values are calculated from a function and/or the associated target temperature values are calculated from a function, wherein a fan speed is calculated and determined from a function, wherein one or more functions described herein are calculated based on one or more stored delta values, target temperature values, ambient air temperature values, actual fan speeds, previous values or speeds, and/or data received from one or more devices exterior to the heater, such as but not limited to other heaters, other temperature sensors, outside air temperature sensors, and the like and combinations thereof.

Figure 15:
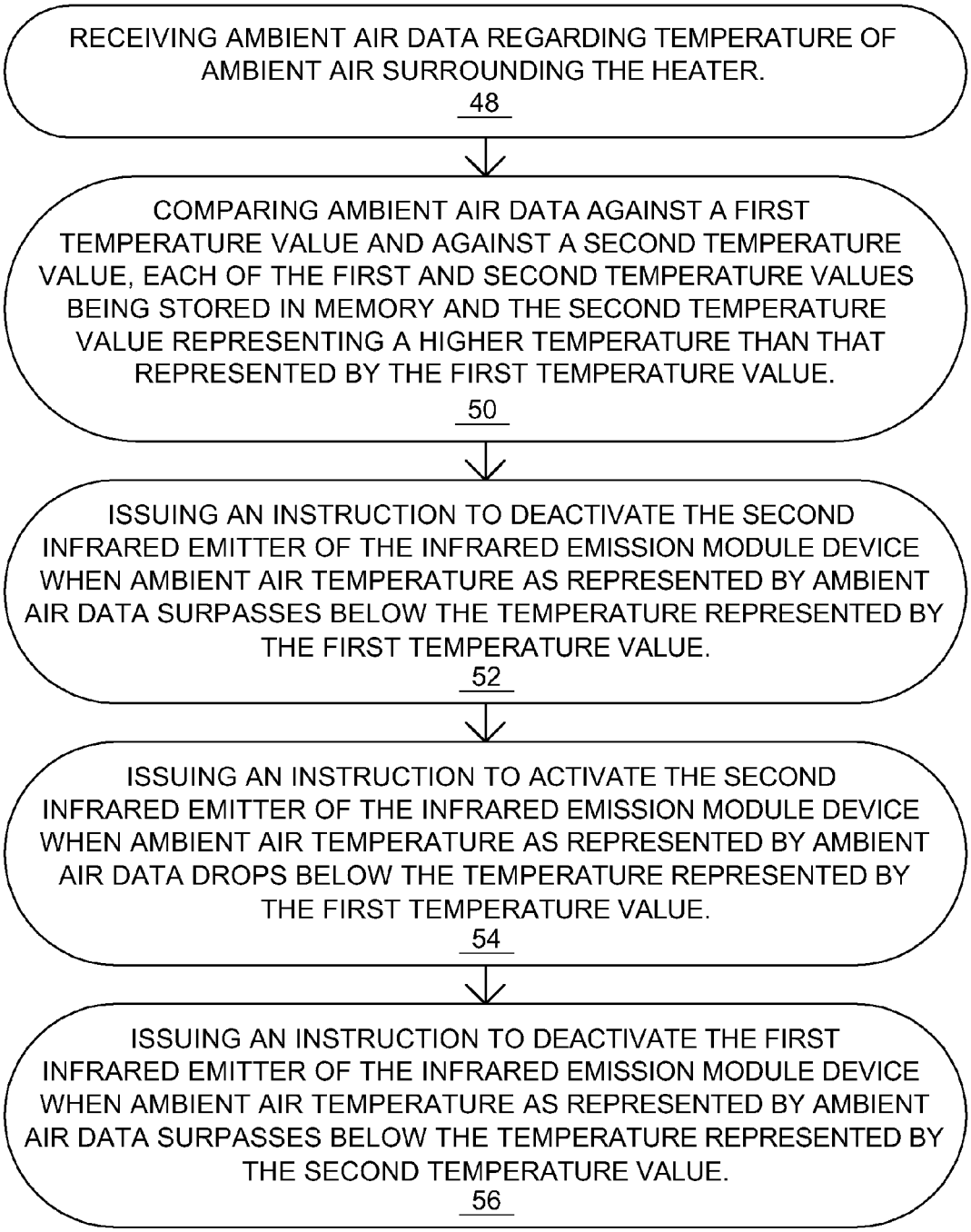
FIG. 15 is a flow chart of a sequence of instructions of a control module of a heater, according to one embodiment of the invention.

FIG. 15 is a flow chart of a sequence of instructions of a control module of a heater, according to one embodiment of the invention. There is shown a set of instructions from a control module configured to reduce the temperature of the ambient air passing through the heater, when a desired temperature is reached.

The heater includes a control module that is in operative communication with the infrared emission module. The control module includes a set of instructions for performing the steps of receiving ambient air data regarding temperature of ambient air surrounding the heater 48. The set of instructions include comparing ambient air data against a first temperature value and against a second temperature value, each of the first and second temperature values may be stored in memory and the second temperature value representing a higher temperature than that represented by the first temperature value 50. The instructions also include issuing an instruction to deactivate the second infrared emitter of the infrared emission module device when ambient air temperature as represented by ambient air data surpasses the temperature represented by the first temperature value 52. The set of instructions further include issuing an instruction to activate the second infrared emitter of the infrared emission module device when ambient air temperature as represented by ambient air data drops below the temperature represented by the first temperature value 54. The set of instructions include issuing an instruction to deactivate the first infrared emitter of the infrared emission module device when ambient air temperature as represented by ambient air data surpasses the temperature represented by the second temperature value 56.

As a non-limiting example, a heater may be activated in a room having an ambient air temperature of 62 degrees Fahrenheit. Such heater may include a temperature sensor disposed thereon and in communication with a control module of the heater. The heater may also include a memory device in communication with the control module wherein preset temperatures and/or other data such as delta values may be stored. One or more interface modules may permit control, setting, initialization, and/or alteration of such settings and thereby the data stored in the memory device(s). For purposes of this example, a first temperature value corresponding to 69 degrees Fahrenheit may be stored therein and a second temperature value corresponding to 72 degrees Fahrenheit may also be stored therein. The heater, when activated may receive data regarding the 62 degree ambient temperature, compare it to the first and second temperature values and activate a first and second infrared emitters and a fan, thereby causing the heater to provide heat to the room. The heater may continue to receive ambient air temperature and compare the same to the stored temperature values. When the ambient air temperature reaches or exceeds the first temperature value, the control module may issue a command to deactivate or otherwise diminish infrared emission from the first emitter, while allowing the second emitter to continue functioning as normal. Accordingly, the rate at which the heater produces heat is reduced. If the heat drops below the first temperature, the first emitter may be reactivated by the control module. If the heat meets and/or exceeds the second temperature, the control module may issue a command to deactivate or otherwise diminish the heat output of the second emitter. Accordingly, the heater may more accurately dispense heat and may do so in a more comfortable manner.

There may be a motion detection module that may be in communication with the control module. Operation of the heater (turning on/off one or more various modules described herein, increasing/decreasing activity/power of one or more mdoules described herein, and etc.) may depend on and/or may change in response to information received from the motion detector module. Non-limiting examples of motion detection modules include those described in U.S. Pat. Nos. 5,216,533; 4,769,545; and 3,611,345, which references are incorporated by reference herein for their supporting teachings.

It is understood that the above example is a simple version of possible operation and that more complicated variations are contemplated in this application, including but not limited to having a plurality of stored delta values associated with one or more target temperatures, wherein stored delta values are calculated from a function and/or the associated target temperature values are calculated from a function, wherein a fan speed is calculated and determined from a function, wherein one or more functions described herein are calculated based on one or more stored delta values, target temperature values, ambient air temperature values, actual fan speeds, previous values or speeds, and/or data received from one or more devices exterior to the heater, such as but not limited to other heaters, other temperature sensors, outside air temperature sensors, and the like and combinations thereof.

The following statements of invention are non-limiting examples of one or more embodiments of the invention:

STATEMENTS OF INVENTION

1. A heater, comprising:

a) a housing including an intake aperture and an output aperture;

b) a heat exchanger operatively disposed within the housing between the intake aperture and the output aperture, the heat exchanger including a shell forming a cavity therein, wherein an interior surface of the shell is substantially black in the infrared domain;

c) an infrared emission module disposed within the cavity of the heat exchanger and substantially enclosed thereby such that emitted infrared light does not escape therefrom, including:

c1) a first infrared emitter; and c2) a second infrared emitter;

d) a fan positioned to motivate air into the housing through the intake aperture, across the heat exchanger, and out of the output aperture; and e) a power module functionally coupled to the infrared emission module and the fan and configured to provide operational power thereto.

2. The heater of claim 1, further comprising a control module in operative communication with the fan, wherein the control module includes a set of instructions for performing the steps of:

a) receiving ambient air data regarding temperature of ambient air surrounding the heater;

b) receiving output air data regarding temperature of air exiting the output aperture of the housing;

c) calculating a difference between the ambient air data and the output air data;

d) comparing the calculated difference against a preset delta value stored in memory;

e) issuing an instruction to slow the fan if the calculated difference is greater than the preset delta value; and f) storing user changes in context such that user behavior can be used predicatively.

3. The heater of claim 1, further comprising a control module in operative communication with the infrared emission module, wherein the control module includes a set of instructions for performing the steps of:

a) receiving ambient air data regarding temperature of ambient air surrounding the heater; and b) comparing ambient air data against a first temperature value and against a second temperature value, each of the first and second temperature values being stored in memory and the second temperature value representing a higher temperature than that represented by the first temperature value.

4. The heater of claim 3, wherein the set of instructions further comprises the instruction for performing the step of issuing an instruction to deactivate the second infrared emitter of the infrared emission module device when ambient air temperature as represented by ambient air data surpasses the temperature represented by the first temperature value.

5. The heater of either of claim 3 or 4, wherein the set of instructions further comprises the instruction for performing the step of issuing an instruction to activate the second infrared emitter of the infrared emission module device when ambient air temperature as represented by ambient air data drops below the temperature represented by the first temperature value.

6. The heater of any of claims 3-5, wherein the set of instructions further comprises the instruction for performing the step of issuing an instruction to deactivate the first infrared emitter of the infrared emission module device when ambient air temperature as represented by ambient air data surpasses the temperature represented by the second temperature value.

7. The heater of claim 1 further comprising a control module in operative communication with the infrared emission module, wherein the control module includes a set of instructions for performing the steps of:

a) receiving ambient air data regarding temperature of ambient air surrounding the heater;

b) comparing ambient air data against a first temperature value and against a second temperature value, each of the first and second temperature values being stored in memory and the second temperature value representing a higher temperature than that represented by the first temperature value;

c) issuing an instruction to deactivate the second infrared emitter of the infrared emission module device when ambient air temperature as represented by ambient air data surpasses the temperature represented by the first temperature value;

d) issuing an instruction to activate the second infrared emitter of the infrared emission module device when ambient air temperature as represented by ambient air data drops below the temperature represented by the first temperature value;

e) issuing an instruction to deactivate the first infrared emitter of the infrared emission module device when ambient air temperature as represented by ambient air data surpasses the temperature represented by the second temperature value;

f) receiving ambient air data regarding temperature of ambient air surrounding the heater;

g) receiving output air data regarding temperature of air exiting the output aperture of the housing;

h) calculating a difference between the ambient air data and the output air data;

i) comparing the calculated difference against a preset delta value stored in memory;

j) issuing an instruction to slow the fan if the calculated difference is greater than the preset delta value; and k) storing user changes in context such that user behavior can be used predicatively.

8. The heater of any preceding claim, wherein the shell of the heat exchanger comprises anodized aluminum.

9. The heater of any preceding claim, wherein the intake aperture is disposed along sides of the housing.

10. The heater of any preceding claim, wherein the infrared emission module further includes a third infrared emitter and a fourth infrared emitter disposed within the cavity of the heat exchanger.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate particular shapes and proportions for the parts described, it is understood that, except where specifically limited by the claims, the shapes, sizes, proportions and positions of the parts described herein are plethoric.

Additionally, although the figures illustrate particular embodiments having one or more features, it is envisioned that any and/or all of the features describe herein may be present in one or more embodiments of the invention.

It is also envisioned that such heaters may be adapted for a variety of uses including but not limited to being placed in homes, offices, schools, industrial complexes, outdoors, garages, manufacturing facilities, hospitals, and the like and combinations thereof.

It is expected that there could be numerous variations of the design of this invention. An example is that the housing may be shaped as a sphere, ovoid, cube, rectangle, irregularly shaped, and the like and combinations thereof.

Finally, it is envisioned that the components of the device may be constructed of a variety of materials, including but not limited to metals, ceramics, plastics, rubber, fibers, woven materials, wood, composites, and combinations thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A heater, comprising:

a) a housing including an intake aperture and an output aperture;

b) a heat exchanger operatively disposed within the housing between the intake aperture and the output aperture, the heat exchanger including a shell forming a cavity therein, wherein an interior surface of the shell is substantially black in the infrared domain;

c) an infrared emission module disposed within the cavity of the heat exchanger and substantially enclosed thereby such that emitted infrared light does not escape therefrom, including:

c1) a first infrared emitter; and c2) a second infrared emitter;

d) a fan positioned to motivate air into the housing through the intake aperture, across the heat exchanger, and out of the output aperture; and e) a power module functionally coupled to the infrared emission module and the fan and configured to provide operational power thereto.

2. The heater of claim 1, further comprising:

a temperature sensor;

a memory module in communication with the temperature sensor and configured to store preset temperatures and other data; and a control module in communication with each of the temperature sensor, the memory module, and the infrared emission module over a wireless network, and configured to issue commands thereto.

3. The heater of claim 2, wherein the control module includes a touchscreen and wherein the memory module includes a database on a server remote from the housing and in communication therewith through a network.

4. The heater of claim 1, further comprising a control module in operative communication with the fan, wherein the control module includes a set of instructions for performing the steps of:

a) receiving ambient air data regarding temperature of ambient air surrounding the heater;

b) receiving output air data regarding temperature of air exiting the output aperture of the housing;

c) calculating a difference between the ambient air data and the output air data;

d) comparing the calculated difference against a preset delta value stored in memory; and e) issuing an instruction to slow the fan if the calculated difference is greater than the preset delta value.

5. The heater of claim 1, further comprising a control module in operative communication with the infrared emission module, wherein the control module includes a set of instructions for performing the steps of:

a) receiving ambient air data regarding temperature of ambient air surrounding the heater; and b) comparing ambient air data against a first temperature value and against a second temperature value, each of the first and second temperature values being stored in memory and the second temperature value representing a higher temperature than that represented by the first temperature value.

6. The heater of claim 5, further including the instruction for performing the step of issuing an instruction to deactivate the second infrared emitter of the infrared emission module device but not to deactivate the first infrared emitter when ambient air temperature as represented by ambient air data surpasses the temperature represented by the first temperature value.

7. The heater of claim 5, further including the instruction for performing the step of issuing an instruction to activate the second infrared emitter of the infrared emission module device when ambient air temperature as represented by ambient air data drops below the temperature represented by the first temperature value.

8. The heater of claim 5, further including the instruction for performing the step of issuing an instruction to deactivate the first infrared emitter of the infrared emission module device when ambient air temperature as represented by ambient air data surpasses the temperature represented by the second temperature value.

9. The heater of claim 5, further including the instruction for performing the steps of:

a) issuing an instruction to deactivate the second infrared emitter of the infrared emission module device when ambient air temperature as represented by ambient air data surpasses the temperature represented by the first temperature value;

b) issuing an instruction to activate the second infrared emitter of the infrared emission module device when ambient air temperature as represented by ambient air data drops below the temperature represented by the first temperature value; and c) issuing an instruction to deactivate the first infrared emitter of the infrared emission module device when ambient air temperature as represented by ambient air data surpasses the temperature represented by the second temperature value.

10. The heater of claim 1, wherein the infrared emission module further includes a third infrared emitter and a fourth infrared emitter disposed within the cavity of the heat exchanger.

11. A heater, comprising:

a) a housing including an intake aperture and an output aperture;

b) a heat exchanger operatively disposed within the housing between the intake aperture and the output aperture, the heat exchanger including a shell forming a cavity therein, wherein an interior surface of the shell is substantially black in the infrared domain;

c) an infrared emission module disposed within the cavity of the heat exchanger and substantially enclosed thereby such that emitted infrared light does not escape therefrom, including:

c1) a first infrared emitter; and c2) a second infrared emitter;

d) a fan positioned to motivate air into the housing through the intake aperture, across the heat exchanger, and out of the output aperture;

e) a power module functionally coupled to the infrared emission module and the fan and configured to provide operational power thereto; and f) further comprising a control module in operative communication with the infrared emission module, wherein the control module includes a set of instructions for performing the steps of:

f1) receiving ambient air data regarding temperature of ambient air surrounding the heater;

f2) comparing ambient air data against a first temperature value and against a second temperature value, each of the first and second temperature values being stored in memory and the second temperature value representing a higher temperature than that represented by the first temperature value;

f3) issuing an instruction to deactivate the second infrared emitter of the infrared emission module device but not to deactivate the first infrared emitter when ambient air temperature as represented by ambient air data surpasses the temperature represented by the first temperature value;

f4) issuing an instruction to activate the second infrared emitter of the infrared emission module device when ambient air temperature as represented by ambient air data drops below the temperature represented by the first temperature value; and f5) issuing an instruction to deactivate the first infrared emitter of the infrared emission module device when ambient air temperature as represented by ambient air data surpasses the temperature represented by the second temperature value.

12. The heater of claim 11, further comprising:

a temperature sensor;

a memory module in communication with the temperature sensor and configured to store preset temperatures and other data; and a control module in communication with each of the temperature sensor, the memory module, and the infrared emission module over a wireless network, and configured to issue commands thereto.

13. The heater of claim 12, wherein the control module includes a touchscreen and wherein the memory module includes a database on a server remote from the housing and in communication therewith through a network.

14. The heater of claim 13, wherein the control module is in operative communication with the fan, wherein the control module includes a set of instructions for performing the steps of:

a) receiving ambient air data regarding temperature of ambient air surrounding the heater;

b) receiving output air data regarding temperature of air exiting the output aperture of the housing;

c) calculating a difference between the ambient air data and the output air data;

d) comparing the calculated difference against a preset delta value stored in memory; and e) issuing an instruction to slow the fan if the calculated difference is greater than the preset delta value.

15. The heater of claim 14, wherein the infrared emission module further includes a third infrared emitter and a fourth infrared emitter disposed within the cavity of the heat exchanger.

16. A heater, comprising:

a) a housing including an intake aperture and an output aperture; wherein the intake aperture is disposed along the sides of the housing;

b) a heat exchanger operatively disposed within the housing between the intake aperture and the output aperture, the heat exchanger including a shell forming a cavity therein, wherein an interior surface of the shell is substantially black in the infrared domain; wherein the shell of the heat exchanger includes anodized aluminum;

c) an infrared emission module disposed within the cavity of the heat exchanger and substantially enclosed thereby such that emitted infrared light does not escape therefrom, including:

c1) a first infrared emitter;

c2) a second infrared emitter;

c3) a third infrared emitter; and c4) a fourth infrared emitter;

d) a fan positioned to motivate air into the housing through the intake aperture, across the heat exchanger, and out of the output aperture;

e) a power module functionally coupled to the infrared emission module and the fan and configured to provide operational power thereto; and f) a control module in operative communication with the infrared emission module, wherein the control module includes a set of instructions for performing the steps of:

f1) receiving ambient air data regarding temperature of ambient air surrounding the heater;

f2) comparing ambient air data against a first temperature value and against a second temperature value, each of the first and second temperature values being stored in memory and the second temperature value representing a higher temperature than that represented by the first temperature value;

f3) issuing an instruction to deactivate the second infrared emitter of the infrared emission module device but not to deactivate the first infrared emitter when ambient air temperature as represented by ambient air data surpasses the temperature represented by the first temperature value;

f4) issuing an instruction to activate the second infrared emitter of the infrared emission module device when ambient air temperature as represented by ambient air data drops below the temperature represented by the first temperature value;

f5) issuing an instruction to deactivate the first infrared emitter of the infrared emission module device when ambient air temperature as represented by ambient air data surpasses the temperature represented by the second temperature value;

f6) receiving ambient air data regarding temperature of ambient air surrounding the heater;

f7) receiving output air data regarding temperature of air exiting the output aperture of the housing;

f8) calculating a difference between the ambient air data and the output air data;

f9) comparing the calculated difference against a preset delta value stored in memory;

f10) issuing an instruction to stow the fan if the calculated difference is greater than the preset delta value; and f11) storing user changes in context such that user behavior can be used predicatively.

* * * * *